US005908197A

United States Patent [19]

Strothmann et al.

[11] Patent Number: 5,908,197

[45] Date of Patent: Jun. 1, 1999

[54] BRAKING ASSEMBLY FOR AN IN-LINE ROLLER SKATE

[76] Inventors: Achim Strothmann, Schulstr. 22, D-37120 Bovenden; Thomas Strothmann, Noldestr. 3, D-49134 Wallenhorst, both of Germany

[21] Appl. No.: 09/095,473

[22] Filed: Jun. 10, 1998

[51] Int. Cl.[6] ..... A63C 17/14

[52] U.S. Cl. ..... 280/11.2; 280/11.22; 188/71.1

[58] Field of Search ..... 280/11.2, 11.19, 280/11.22, 11.23; 188/71.1, 18 A, 26

[56] References Cited

U.S. PATENT DOCUMENTS

| | | | |
|---|---|---|---|
| 5,143,387 | 9/1992 | Colla | 280/11.2 |
| 5,232,231 | 8/1993 | Carlsmith | 280/11.2 |
| 5,280,930 | 1/1994 | Smathers et al. | 280/11.2 |
| 5,375,859 | 12/1994 | Peck et al. | 280/11.2 |
| 5,403,021 | 4/1995 | Shifrin | 280/11.2 |
| 5,609,346 | 3/1997 | Bellehumeur | 280/11.2 |
| 5,657,999 | 8/1997 | Beaulieu | 280/11.2 |
| 5,752,707 | 5/1998 | Cottle et al. | 280/11.2 |
| 5,758,884 | 6/1998 | Flater | 280/11.2 |
| 5,769,432 | 6/1998 | Tybinkowski et al. | 280/11.2 |
| 5,769,433 | 6/1998 | Zorzi et al. | 280/11.2 |
| 5,772,221 | 6/1998 | Daley | 280/11.2 |

*Primary Examiner*—Richard M. Camby
*Assistant Examiner*—Andrew J. Fischer
*Attorney, Agent, or Firm*—Thomas, Kayden, Horstemeyer & Risley

[57] ABSTRACT

A braking assembly for an in-line roller skate is disclosed. The braking assembly comprises a foot operatable actuation means and at least one rod having a non-circular cross-section and essentially extending in parallel to the moving direction of the in-line roller skate. Upon operating of said foot operatable actuation means, the rod is turned about its longitudinal axis and thereby applying an axial braking force to the sidewall of at least one of the rollers.

11 Claims, 5 Drawing Sheets

BRAKING ASSEMBLY FOR AN IN-LINE ROLLER SKATE

FIELD OF THE INVENTION

This invention relates in general to braking assemblies for in-line roller skates. More particularly, this invention relates to braking assemblies for in-line roller skates which apply the braking force to the sidewalls of the rollers and which are foot operatable.

BACKGROUND OF THE INVENTION

In recent years in-line roller skates have achieved great popularity. Such in-line roller skates are characterized by a plurality of rollers mounted at the bottom of a shoe or a boot where the rollers are situated in alignment with each other along the moving direction of the skate. Thus, the rollers appear to simulate the blade of an ice skate.

A problem common to all types of roller skates is the difficulty in slowing down. Thus, various braking systems have been proposed for roller skates but none are entirely satisfactory.

A conventional braking assembly for in-line roller skates includes a brake block arranged at the end of a lever and facing the surface of the street. The lever is connected to the backside of the shoe. The brake block can be brought into contact with the surface of the street by an actuation means or by the user lifting the foreportion of the shoe and thereby lowering the backside of the shoe. This braking assembly requires high skating skills and is not usable in skating backwardly. Additionally, it causes high-wear of the braking block.

Another braking assembly for in-line roller skates is disclosed in U.S. Pat. No. 5,280,930. The braking assembly comprises a brake pad which can be brought into engagement with the sidewalls of the rollers in order to apply an axial braking force to the rollers. The braking assembly can also be used in skating backwardly, but the used mechanism is very complex and must be operated by hand.

Thus, what is needed but seemingly unavailable in the art is a braking assembly for an in-line roller skate constructed and arranged for providing a secure, easy, foot operated braking action which does not require high skating skills.

SUMMARY OF THE INVENTION

Briefly described, the present invention provides a braking assembly for an in-line roller skate that overcomes some of the design deficiencies of other braking assemblies for in-line skates known in the art by providing a braking assembly for an in-line roller skate comprising a foot operatable actuation means and at least one rod having a non-circular cross-section and a longitudinal axis essentially extending in parallel to the moving direction of the in-line roller skate. Upon operating of said foot operatable actuation means, the rod is turned about its longitudinal axis and thereby applying an axial braking force to the sidewall of at least one of the rollers. The axial braking force applied to the sidewalls of the rollers instead of the circumference of the rollers has the advantage of a relatively large braking surface. The risk of dirt or little stones getting between the braking assembly and the rollers and possibly resulting in blocking of the rollers is minimized. Thus, the novel braking assembly provides an axial, planform, steady and easily engageable braking action which is independent of the surface of the street. The braking assembly is also independent of the skating direction, i.e. whether the user skates forwardly or backwardly.

The foot operatable actuation means of the braking assembly may comprise a brake shoe arranged between the surface area of the rod and the sidewall of the roller and covering a substantial part of the sidewall of said roller. A first lever connected to the rod and extending perpendicularly to the rod, and a second lever connected to the end of the first lever and pivoting about an axis perpendicular to the rod may be provided. The second lever is directly foot operatable. In this, a pushing down of the end of the second lever arranged in the shoe by the toes results in a lifting of the other end of the second lever, a lifting of the first lever and a rotation of the rod. Because of the rod having a non-circular cross-section and being located adjacent to the brake shoe, the rotation of the rod results in a movement of the brake shoe in the direction of the sidewall of the roller. An axial braking force is attained that slows down the rollers depending on the braking force applied by the toes.

The second lever may comprise a toe actuator arranged in an area behind the normal position of the toes, the toe actuator being pushed down by a contracting movement of the toes towards the rest of the respective foot. Thus, it is very easy for the user to apply the desired braking force, as the necessary counter force is provided by the upper part of a respective shoe or boot surrounding the foot.

The braking assembly may comprise a second rod having a noncircular cross-section. The two rods are arranged symmetrically to each other and act upon both sidewalls of said roller. Thus, the braking force is applied more evenly and the stability of the braking assembly is improved. Further, a two side arrangement has the advantage of a lower heating up of the sidewalls of the rollers. In case of a two side arrangement the actuation means comprises special parts for each side, and the two rods may each act upon a brake shoe arranged between the respective rod and the sidewall of the rollers.

In addition, the rollers may be made of a material having a high thermal conductivity so that the heating up of the rollers is not concentrated on their sidewalls.

The brake shoe may act upon several rollers. Thus, the braking force is substantially distributed evenly to the rollers.

The braking assembly may comprise a brake disk arranged on the break shoe or a brake lining or brake pad arranged on the roller. In the first case no special rollers are needed. The rollers can be made of a material having a high thermal conductivity, so that no additional brake disk or brake lining is required and the rollers do not heat up too much during braking action.

Furthermore, a resilient means, e.g. a spring or preferably an O-ring, may be located between each brake shoe and the non-rotating inner rings of the adjacent bearings of the rollers or directly between two brake shoes at opposite sidewalls of the rollers. The O-ring biases the brake shoes in a direction away from the rollers, so that unintentional braking is avoided. Furthermore, by this resilient means the braking force is adjustable.

It is an object of the invention to provide a braking assembly for in-line roller skates which applies an axial braking force to the rollers and which is foot operatable.

This and other objects, features and advantages of the invention will become apparent upon reading the specification when taken into conjunction with the accompanying drawings wherein like characters of reference designate corresponding parts throughout the several views.

DETAILED DESCRIPTION

Figure 1:
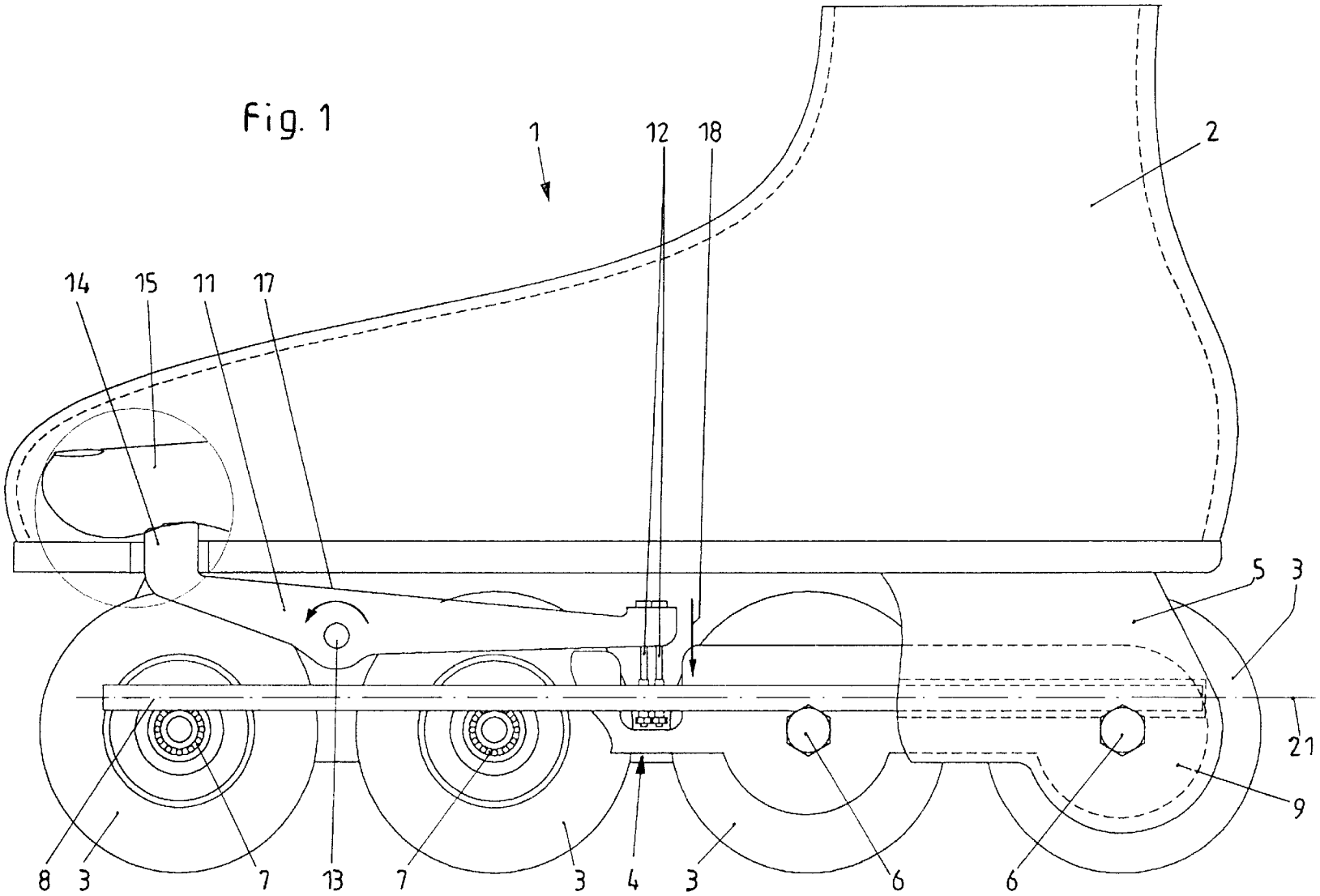
FIG. 1 is a partially broken side view of an in-line roller skate comprising a braking assembly.
Figure 2:
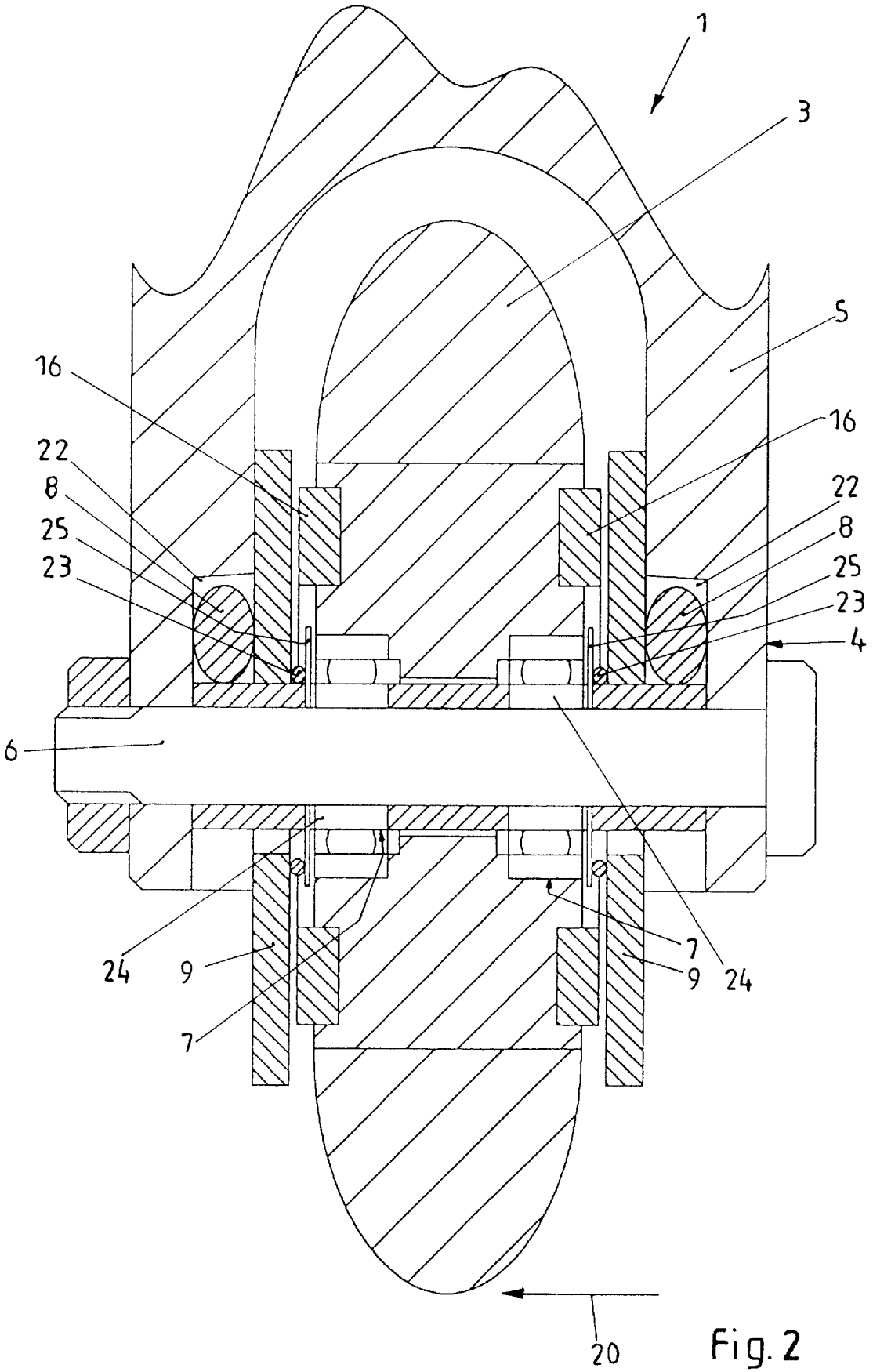
FIG. 2 is a back view of the in-line roller skate.
Figure 3:
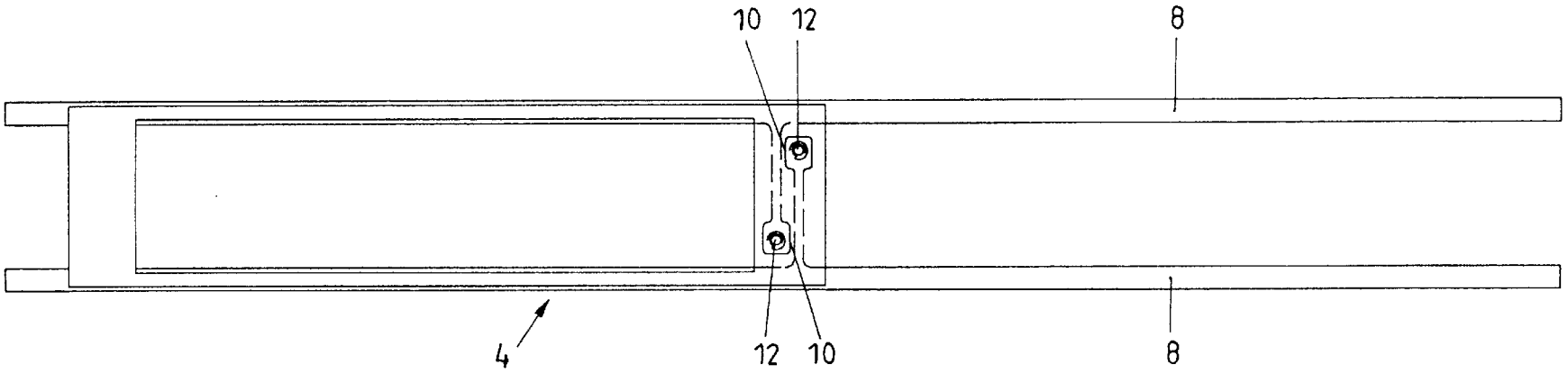
FIG. 3 is a top view of some parts of the braking assembly.
Figure 4:
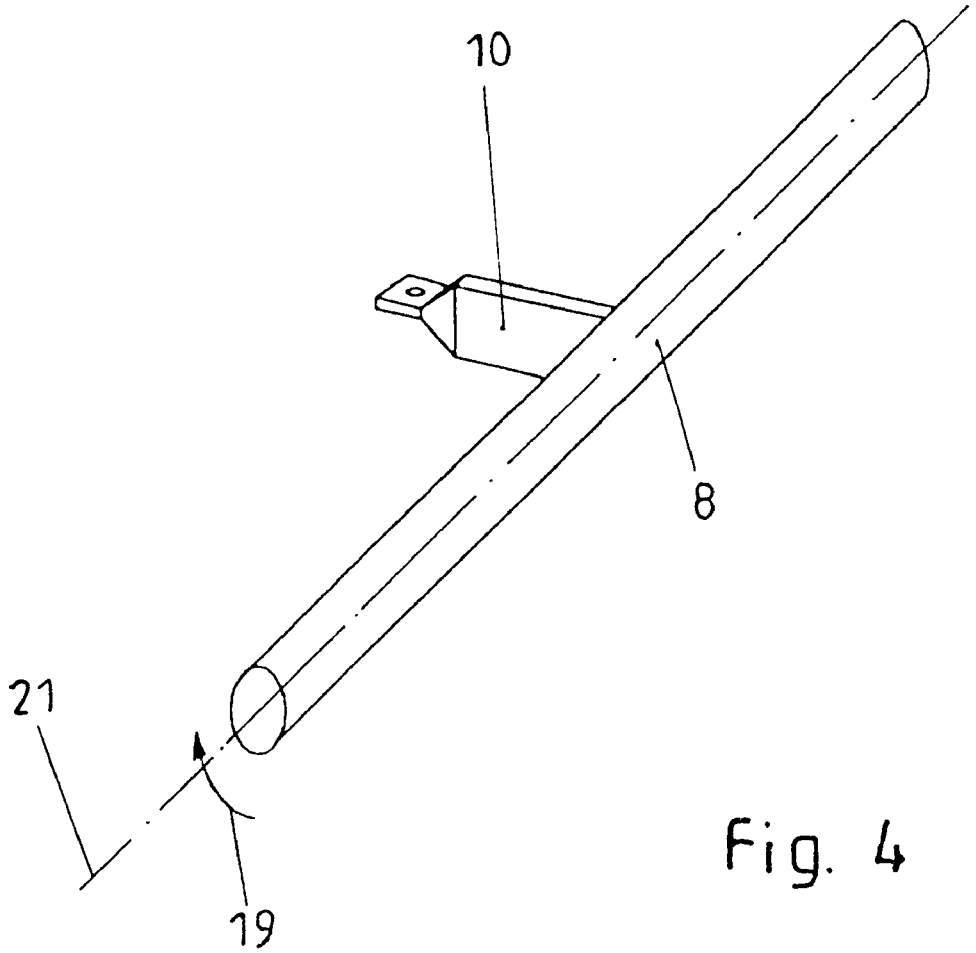
FIG. 4 is a perspective view of a rod with a first lever.

FIGS. 1 to 3 show an in-line roller skate 1 having a shoe 2, a housing 5, rollers 3 and a braking assembly 4. Rollers 3 are rotatably arranged in housing 5 on axles 6 and bearings 7. Further, housing 5 forms the sole of shoe 2 and houses the braking assembly 4. The braking assembly 4 comprises two rods 8 each having a non-circular cross-section and being arranged in grooves 22 in inner sidewalls of the housing facing rollers 3. Grooves 22 are shaped in such a way that rods 8 are turnable about their longitudinal axes 21. On each side of in-line roller skate 1 one brake shoe 9 is located between the surface area of one rod 8 and the sidewalls of rollers 3, and covering a substantial part of the sidewalls of rollers 3. A first lever 10 is connected to the surface area of each rod 8 and extends perpendicularly to rod 8 (FIG. 4). One common second lever 11 is connected to the end of each first lever 10 by connecting elements 12. Second lever 11 is operatable about an axis perpendicular to rod 8 about an axle 13 mounted in housing 5. Second lever 11 with its one end extends inside shoe 2 and comprises a toe actuator 14 arranged in an area behind the normal position of toes 15. Toe actuator 14 is pushed down by a contracting movement of toes 15. In order to activate braking assembly 4, the user contracts toes 15 towards the rest of the respective foot and thereby pushes down tow actuator 14 and the left side of second lever 11. The counter force for depressing the left side of second lever 11 is provided by the upper part of shoe 2. Consequently, the right side of second lever 11 moves upwardly about axle 13. Thus, second lever 11 moves according to arrow 17 about axle 13. Connecting elements 12 move upwardly according to arrow 18 and thereby apply a pulling force to both first levers 10. This pulling force results in both rod 8 turning according to arrow 19. Due to their non-circular cross-section, rods 8 in turn press against both brake shoes 9. Consequently, brake shoes 9 move in the direction of the sidewalls of rollers 3 according to arrow 20 and thereby establishes contact to brake pads 16 arranged on the sidewalls of rollers 3. The friction between brake pads 16 and brake show 9 causes a slowing down of rollers 3. An O-ring 23 is located between brake shoes 9 and a cover plate 25 supported on non-rotating inner rings 24 of adjacent bearings 7 of rollers 3. O-ring 23 biases brake shoes 9 in a direction away from rollers 3, so that unintentional braking is avoided. Furthermore, by choosing an O-ring 23 of a different width, the maximum braking force and deceleration is adjustable.

Figure 5:
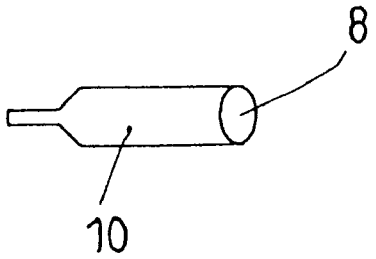
FIG. 5 is a front view of the rod.

FIGS. 4 and 5 show rod 8 with its non-circular cross-section and first lever 10 in detail.

Figure 6:
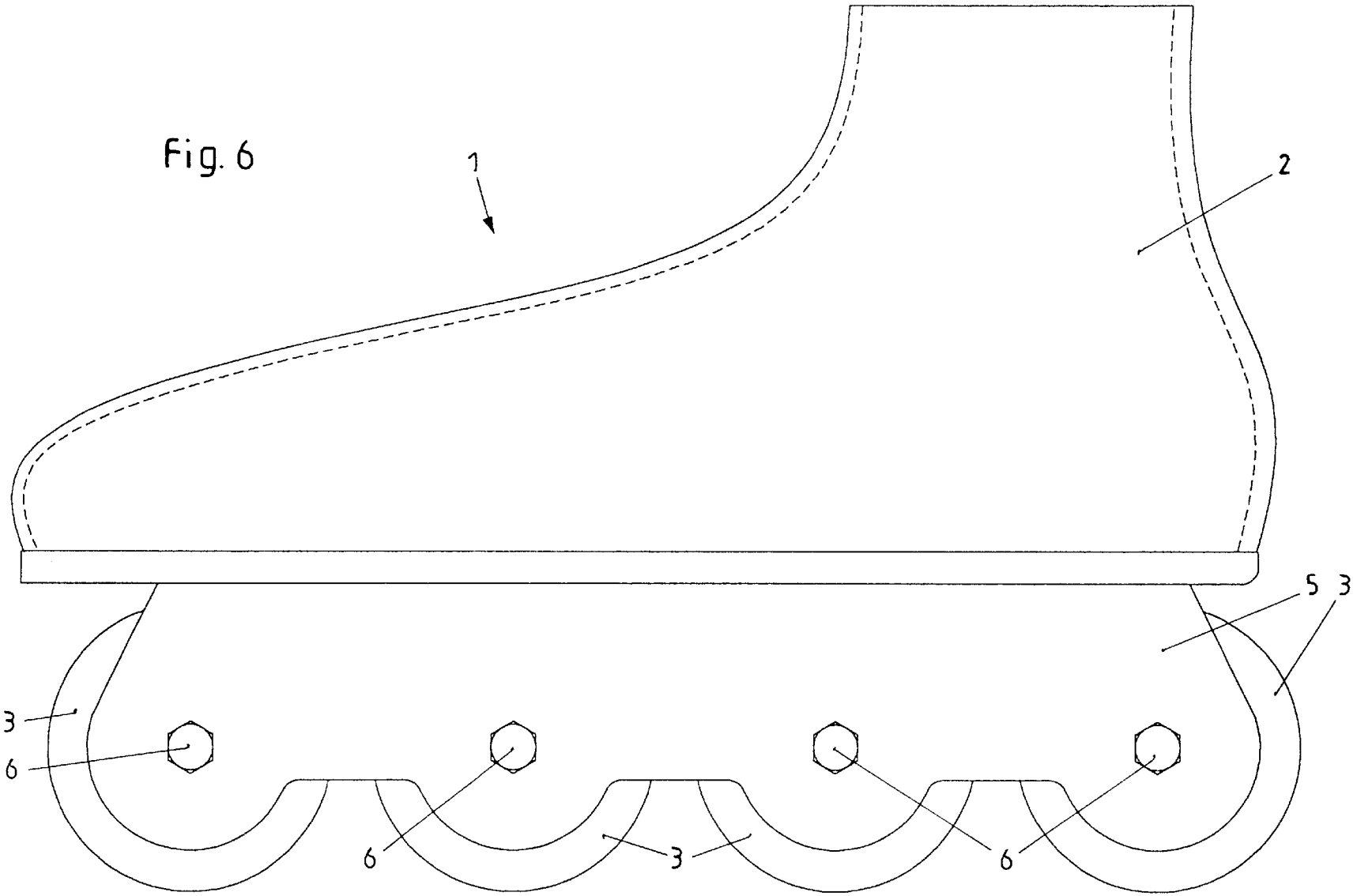
FIG. 6 is a side view of the in-line roller skate comprising a braking assembly.

FIG. 6 shows in-line roller skate 1 in its normal unbroken side view.

Although one long brake shoe is disclosed as being positioned on each side of the rollers, individual brake shoes can be used for each roller and each rod can actuate the brake shoes on opposite sides of the rollers.

While the foregoing specification and drawing describe preferred embodiments of the invention, variations and modifications can be made thereto without departing from the spirit and scope of the invention, as set forth in the following claims.

I claim:

1. A braking assembly for an in-line roller skate, the in-line roller skate including a plurality of rollers situated in alignment with each other along a moving direction of the in-line roller skate, comprising:

a foot operatable actuation means and at least one rod having a non-circular cross-section and a longitudinal axis essentially extending in parallel to the moving direction of the in-line roller skate, upon operating of said foot operatable actuation means, said rod being turned about its longitudinal axis and thereby applying an axial braking force to the sidewall of at least one of said rollers.

2. The braking assembly of claim 1, wherein said foot operable actuation means comprises:

a brake shoe arranged between the surface area of said rod and the sidewall of said roller and covering a substantial part of the sidewall of said roller;

a first lever connected to said rod and extending perpendicularly to said rod; and wherein said foot operable actuation means comprises a second lever connected to the end of said first lever and pivoting about an axis perpendicular to said rod, said second lever being foot operable.

3. The braking assembly of claim 2, wherein said second lever comprises a toe actuator arranged in an area behind the normal position of the toes, said toe actuator being pushed down by a contracting movement of the toes.

4. The braking assembly of claim 2, wherein said brake shoe acts upon several rollers.

5. The braking assembly of claim 2 further comprising a brake disk arranged on said brake shoe.

6. The braking assembly of claim 2 further comprising a brake lining arranged on said roller.

7. The braking assembly of claim 2, wherein the rollers are made of a material having a high thermal conductivity.

8. The braking assembly of claim 2 further comprising another non-circular rod, said rods being arranged symmetrically to each other and acting upon both sidewalls of said roller.

9. The braking assembly of claim 8, further comprising a resilient means located between said brake shoes.

10. The braking assembly of claim 9, wherein said resilient means comprises an O-ring.

11. A roller skate having in-line rollers situated in a line with each other along a moving direction of the in-line roller skate and a braking assembly for slowing the rotation of said rollers, the improvement therein comprising:

at least one brake shoe arranged adjacent at least one of said rollers;

at least one rod member having a longitudinal axis extending approximately parallel to the moving direction of the in-line roller skate and a non-circular portion positioned adjacent said brake shoe;

a foot operable actuation means carried by said roller skate for actuation by the toes of a person using the roller skate;

lever means responsive to the movement of said foot operable actuation means for turning said rod member about its longitudinal axis and urging said non-circular portion toward engagement with said brake shoe and moving said brake shoe into frictional engagement with at least one of said rollers;

whereby upon operating said foot operable actuation means, braking force is applied to the sidewall of at least one of said rollers.

* * * * *